US007818927B1

(12) United States Patent
John

(10) Patent No.: US 7,818,927 B1
(45) **Date of Patent: *Oct. 26, 2010**

(54) REMOVABLE WINDOW INSULATOR

(76) Inventor: Gary K. John, 6054 Leprechaun La, Hartford, WI (US) 53027

( * ) Notice: Subject to any disclaimer, the term of this patent is extended or adjusted under 35 U.S.C. 154(b) by 668 days.

This patent is subject to a terminal disclaimer.

(21) Appl. No.: 11/545,157

(22) Filed: Oct. 10, 2006

Related U.S. Application Data

(63) Continuation-in-part of application No. 10/636,077, filed on Aug. 7, 2003, now Pat. No. 7,228,662.

(51) Int. Cl.
*E06B 1/04* (2006.01)

(52) U.S. Cl. ..... 52/204.1; 52/656.5; 52/204.58

(58) Field of Classification Search ..... 52/204.1, 52/204.71, 213, 215, 656.1, 876.13, 204.5, 52/204.57, 204.58, 204.62
See application file for complete search history.

(56) References Cited

U.S. PATENT DOCUMENTS 2,810,460 A * 10/1957 Winnan ..... 52/657
2,816,632 A * 12/1957 Nardulli ..... 52/656.7
4,033,087 A * 7/1977 Shelver ..... 52/745.15
4,199,900 A * 4/1980 Johnston et al. ..... 49/404
4,462,186 A * 7/1984 Fuller ..... 49/463
4,486,990 A 12/1984 Bauch ..... 52/202
4,831,804 A * 5/1989 Sayer ..... 52/475.1
6,052,957 A 4/2000 Minnich ..... 52/202
7,073,292 B1 * 7/2006 Minter et al. ..... 49/181
2004/0016188 A1 * 1/2004 Berger, Jr. ..... 52/204.53
2005/0235596 A1 * 10/2005 Pegorado ..... 52/656.9

* cited by examiner

*Primary Examiner*—Richard E Chilcot, Jr
*Assistant Examiner*—Jessica Laux
(74) *Attorney, Agent, or Firm*—Donald J. Ersler

(57) ABSTRACT

A removable window insulator preferably includes at least one pane, at least four frame members, at least four compressible seals and at least four adjusting members. At least one frame member is mitered on each end thereof. An edge seal strip is attached to an outer edge of each frame member. A single compressible seal is inserted between ends of two adjacent frame members. A single adjusting member is used to set a distance between adjacent frame members. At least one cross member may be secured in an inner perimeter of the removable window insulator. Second and third embodiments of the removable window insulator are used to seal a double window. A fourth embodiment of the removable window insulator is used to seal a window with a partially curved perimeter.

19 Claims, 9 Drawing Sheets

REMOVABLE WINDOW INSULATOR

CROSS-REFERENCES TO RELATED APPLICATIONS

This is a continuation-in-part application taking priority from Ser. No. 10/636,077 filed on Aug. 7, 2003 now U.S. Pat. No. 7,228,662.

BACKGROUND OF THE INVENTION

1. Field of the Invention

The present invention relates generally to windows and more specifically to a removable window insulator, which provides an air tight seal with a window frame.

2. Discussion of the Prior Art

The prior art provides numerous window inserts for insulating an interior of a home from outside air. Some of these prior art window inserts include U.S. Pat. No. 4,462,186 to Fuller, U.S. Pat. No. 4,486,990 to Bauch and U.S. Pat. No. 6,052,957 to Minnich. The Fuller patent discloses a self-adjusting window unit with corner assembly. The Fuller device permits continued adjustment of the frame while providing strength for the frame at the corners and while maintaining a fully insulated frame. The Bauch patent discloses a removable window insulation system. The Bauch device comprises a panel formed of a rigid foam insulation board dimensioned less than the interior casing dimensions of a window. The Minnich patent discloses a compressible insert. The Minnich device includes a sheet which is retained in an adjustable frame. However, to fully seal the compressible insert to a window frame, at least one fastener must be screwed through the adjustable frame into the window frame.

Accordingly, there is a clearly felt need in the art for a removable window insulator, which provides an air tight seal with a window frame; can be adjusted to fit into a window frame without modifying the window frame; and may be quickly removed once adjusted to fit the window.

SUMMARY OF THE INVENTION

The present invention provides a removable window insulator, which provides an air tight seal with a window frame. A removable window insulator preferably includes at least one pane, at least four frame members, at least four compressible seals and at least four adjusting members. Each compressible seal is fabricated from a material that has memory, such that after being compressed, the compressible seal returns to its original shape. Preferably, at least two vertical and two horizontal frame members are mitered on each end thereof. Each frame member includes a pane slot formed on an inside edge thereof that is sized to receive an outer perimeter of the at least one pane. An edge seal strip is attached to an outer edge of the frame member. A single compressible seal is inserted between adjacent mitered ends of two adjacent frame members. An adjusting member is used to set a distance between adjacent frame members. At least one cross member may be secured in substantially a middle of the removable window insulator. However, at least two panes would be required instead of one. Two additional adjusting members and two compressible seals would be required to retain the cross member. The cross member allows adjustment of the removable window insulator in substantially a middle thereof.

A second embodiment of the removable window insulator is used to seal a double window. The second embodiment of the removable window insulator additionally includes a vertical cross member and a second horizontal cross member.

One end of the vertical cross member is rigidly attached to the first horizontal frame member and the other end of the vertical cross member is rigidly attached to the second horizontal frame member. The two horizontal frame members are made long enough to accommodate the width of a double window. A first compressible seal is inserted between a first vertical frame member and the first cross member. One end of the first cross member is attached to the first vertical frame member with an adjusting member. The other end of the first cross member is rigidly attached to the vertical cross member. A second compressible seal is inserted between the second vertical frame member and one end of the second cross member. The one end of the second cross member is attached to the vertical frame member with an adjusting member. The other end of the second cross member is rigidly attached to the vertical cross member.

A third embodiment of the removable window insulator is used to seal a double window. The third embodiment of the removable window insulator includes placing two removable window insulators adjacent to each other. A cross member of a first removable window insulator includes a rigid connection between the other end of the cross member and a second vertical frame member of the first removable window insulator. A cross member of a second removable window insulator includes a rigid connection between the other end of the cross member and a first vertical frame member of the second removable window insulator.

A fourth embodiment of the removable window insulator is used to seal a window with a partially curved perimeter. The fourth embodiment of the removable window insulator includes two vertical frame members, a horizontal frame member and a curved frame member. A first compressible miter seal is inserted between one end of the first vertical frame member and one end of the horizontal frame member. A second compressible miter seal is inserted between the one end of the second vertical frame member and the other end of the horizontal frame member.

A first compressible seal is inserted between the one end of the curved frame member and the other end of the first vertical frame member. A second compressible seal is inserted between the junction of the other end of the curved frame member and the other end of the second vertical frame member. Preferably, a plurality of panes and cross members are retained within the frame members of the fourth embodiment of the removable window insulator.

The compressible seals and adjusting members enable the removable window insulators to snugly seal an inside perimeter of nearly any window, including those, which are not perfectly square or do not have perfectly flat contact surfaces.

Accordingly, it is an object of the present invention to provide a removable window insulator, which provides an air tight seal with a window frame.

It is a further object of the present invention to provide a removable window insulator, which can be adjusted to fit into a window frame without modifying the window frame.

Finally, it is another object of the present invention to provide a removable window insulator, which may be quickly removed, once adjusted to fit the window.

These and additional objects, advantages, features and benefits of the present invention will become apparent from the following specification.

DETAILED DESCRIPTION OF THE PREFERRED EMBODIMENTS

Figure 1:
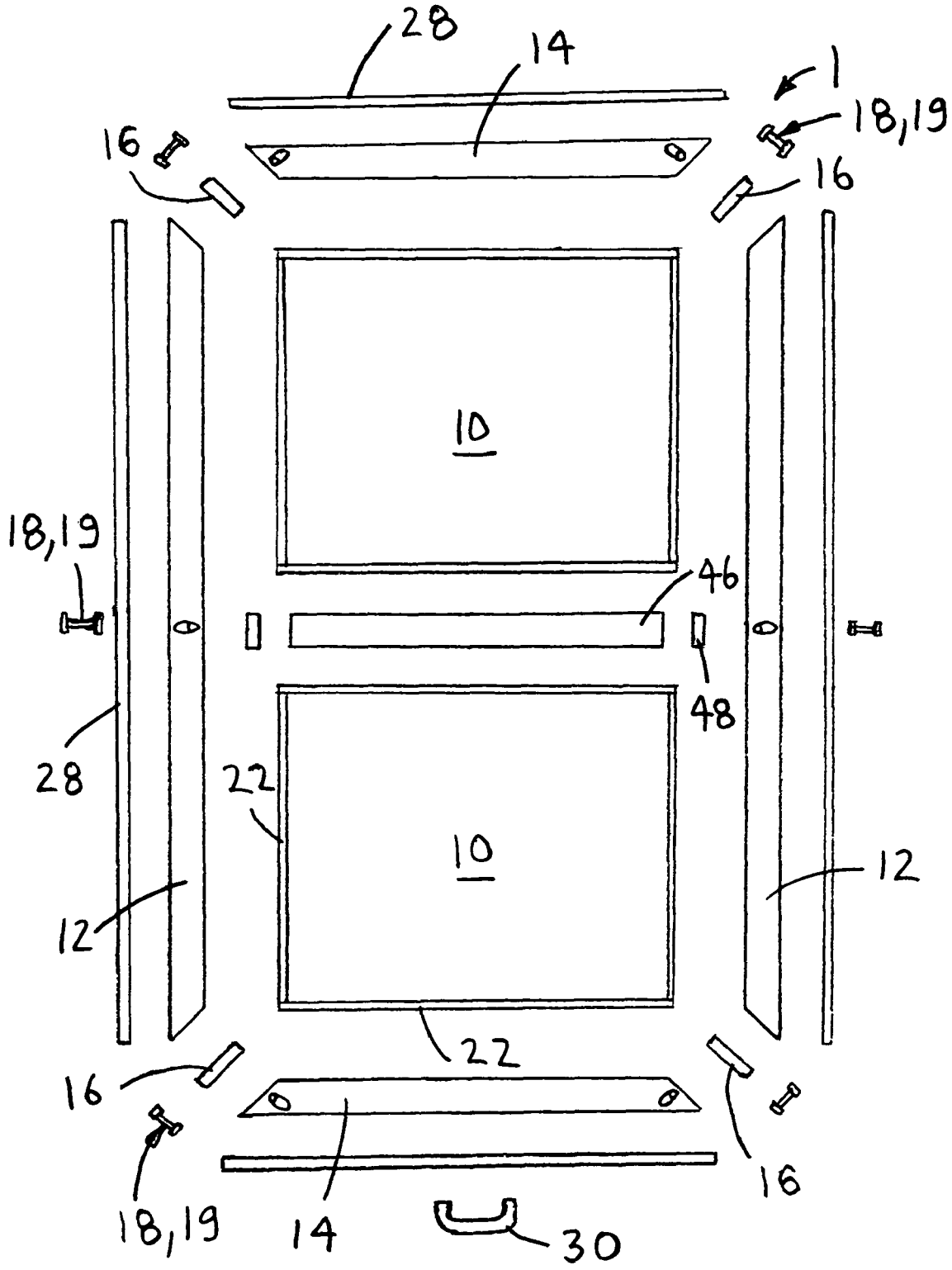
FIG. 1 is a partial front exploded view of a removable window insulator in accordance with the present invention.
Figure 2:
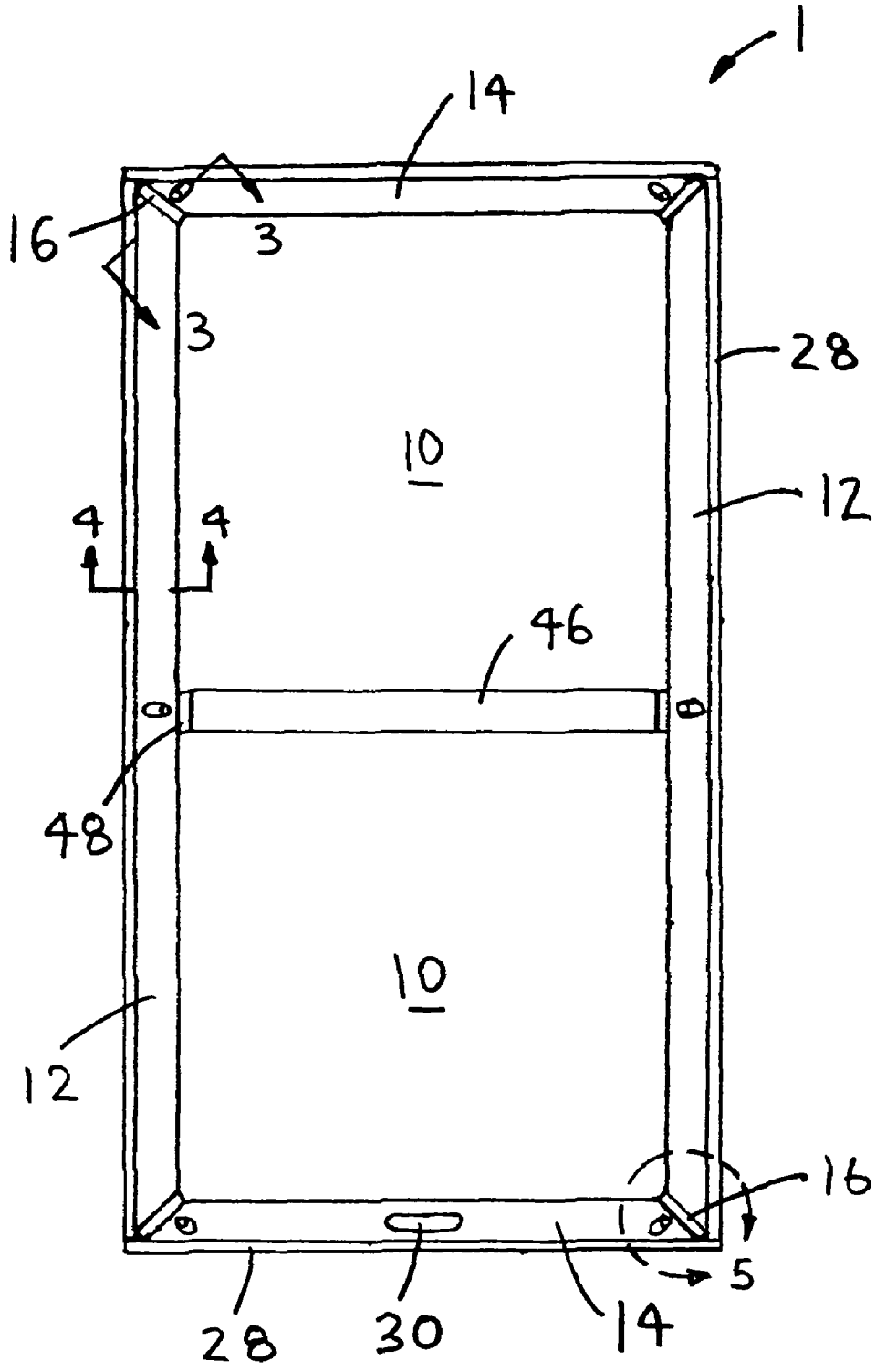
FIG. 2 is a front view of a removable window insulator in accordance with the present invention.
Figure 3:
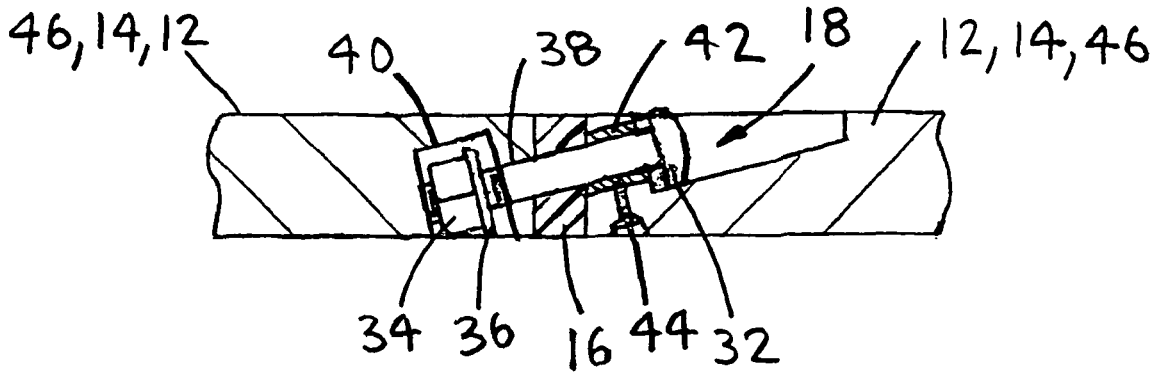
FIG. 3 is a cross sectional view of an adjusting member retaining two adjacent frame members of a removable window insulator in accordance with the present invention.
Figure 4:
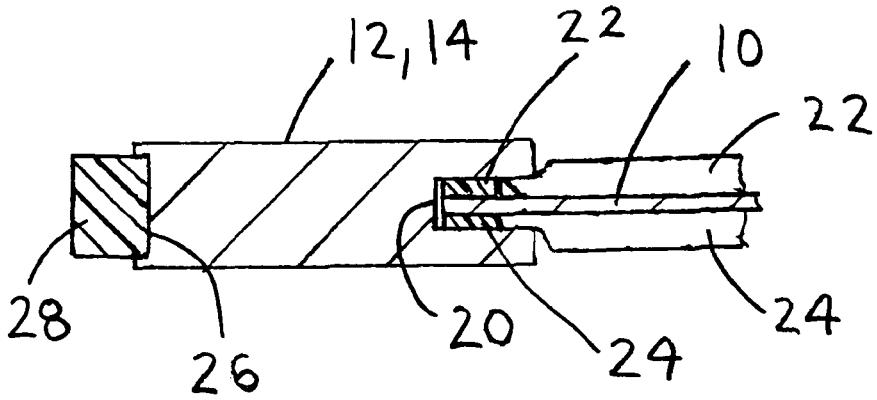
FIG. 4 is a cross sectional view of a frame member adjacent a pane of a removable window insulator in accordance with the present invention.

With reference now to the drawings, and particularly to FIG. 1, there is shown a partial exploded perspective view of a removable window insulator 1. With reference to FIGS. 2-5*a*, the removable window insulator 1 preferably includes at least one pane 10, at least two vertical frame members 12, at least two horizontal frame members 14, at least four compressible miter seals 16 and at least four adjusting members 18. The compressible seals are fabricated from a material that has memory, such that after being compressed, the compressible seal returns to its original shape. Preferably, each pane 10 is fabricated from a clear plastic, such as plexiglass, acrylic or any other suitable material. Miter angle "A" preferably has a value of 45 degrees. However, other miter angle values may also be used. The miter angle "A" is formed on each end of the at least two vertical and horizontal frame members. Each frame member includes a pane slot 20 formed on an inside edge thereof that is sized to receive an outer perimeter of the at least one pane 10. The frame members have inside edges that form an inside edge perimeter. A front seal strip 22 is attached to a front peripheral edge of each pane 10 and a rear seal strip 24 is attached to a rear peripheral edge of each pane 10. The front and rear seal strips provide a seal from a rear of the removable window insulator to a front thereof. However, other methods of sealing the pane to the inside edge of each frame member may also be used.

Each frame member preferably includes a seal retention groove 26 formed on an outside edge thereof that is sized to receive an edge seal strip 28. The edge seal strip 28 is retained in the seal retention groove 26 with any suitable attachment method, such as bonding. A single compressible miter seal 16 is inserted between adjacent mitered ends of two adjacent frame members. At least one handle 30 is preferably attached to a bottom horizontal frame member 14. Each adjusting member 18 preferably includes a fastener 32, a nut 34 and a washer 36. However, other types of adjusting members may also be used. A fastener hole 38 is formed through the compressible miter seal 16 and the two adjacent frame members to receive the fastener 32.

Each fastener hole 38 is terminated with a nut cavity 40. The nut cavity 40 is formed in an inside surface of one of the frame members to receive the nut 34 and the washer 36. A threaded sleeve 42 is preferably inserted into an entrance of the fastener hole 38. An anti-rotation screw 44 may be screwed into a side of the threaded sleeve 42 to prevent rotation thereof. A head of the fastener 32 may originate in the vertical frame member as shown or in the horizontal frame member 14.

At least one cross member 46 may between secured between the two vertical frame members 12. At least two panes 10 would be required instead of one. Two additional adjusting members 18 and two compressible seals 48 would be used to attach each cross member 46 between the two vertical frame members 12. The cross member 46 allows adjustment of the removable window insulator 1 in substantially a middle thereof. The head of the fastener 32 may originate in the vertical frame member 12 as shown or in the cross member 46. A pair of dowel pins 50 are preferably used to align two adjacent frame members with each other. A slip fit hole is preferably formed in each adjacent frame member to receive each dowel pin 50. Each dowel pin 50 could also be pressed into one adjacent frame member. A clearance hole is formed through the compressible miter seal 16 to receive each dowel pin 50.

The fastener 32 is rotated in one direction to decrease the distance between the ends of two adjacent frame members or to decrease an outer perimeter of the removable window insulator 1. The same rotation direction could also decrease the distance between the frame member 12, 14 and the cross member 46. The fastener 32 is rotated in the opposite direction to increase the distance between two adjacent frame members and increase an outer perimeter of the removable window insulator 1. The same rotation direction could also increase the distance between the frame member 12, 14 and the cross member 46. An end of the fastener 32 and/or nut 34 exerts force against a wall of the nut cavity 40 to increase the distance between the two adjacent frame members or between the frame member 12, 14 and the cross member 46.

Figure 5:
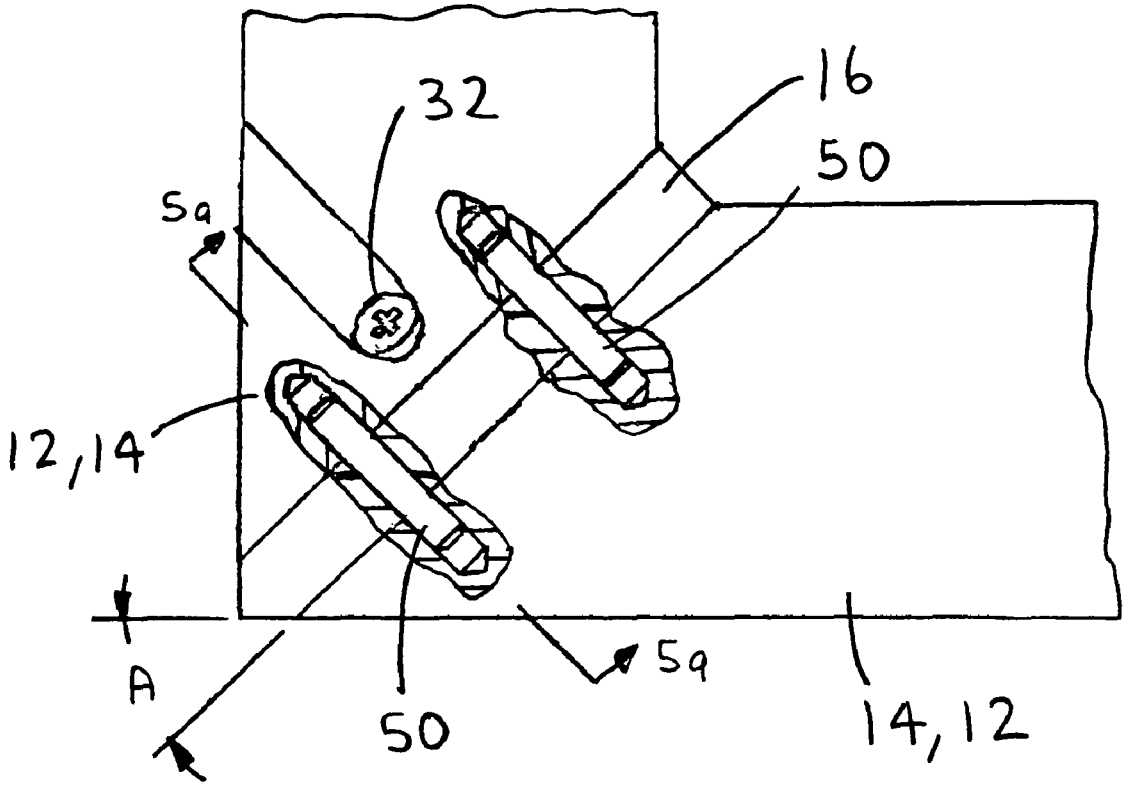
FIG. 5 is an enlarged front view of a junction between two adjacent members of a removable window insulator in accordance with the present invention.
Figure 5A:
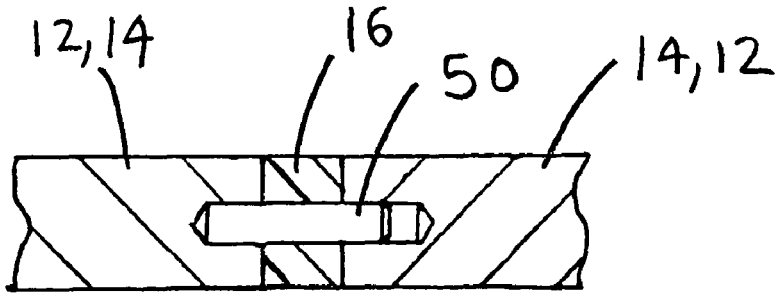
FIG. 5*a* is a cross sectional view cut through FIG. 5 of a removable window insulator in accordance with the present invention.
Figure 5B:
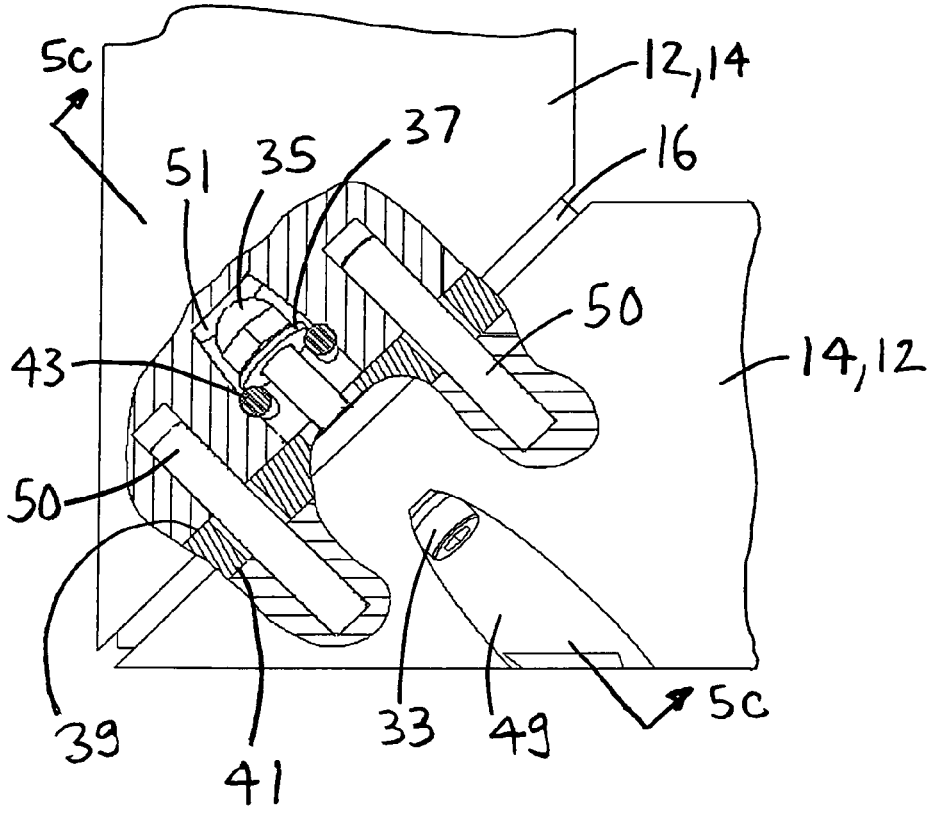
FIG. 5*b* is an enlarged front view of an alternative embodiment of sealing and securing two adjacent frame members of a removable window insulator in accordance with the present invention.
Figure 5D:
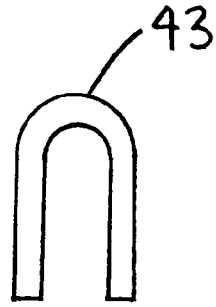
FIG. 5*d* is a front view of a retention pin of an alternative embodiment of sealing and securing two adjacent members of a removable window insulator in accordance with the present invention.
Figure 5C:
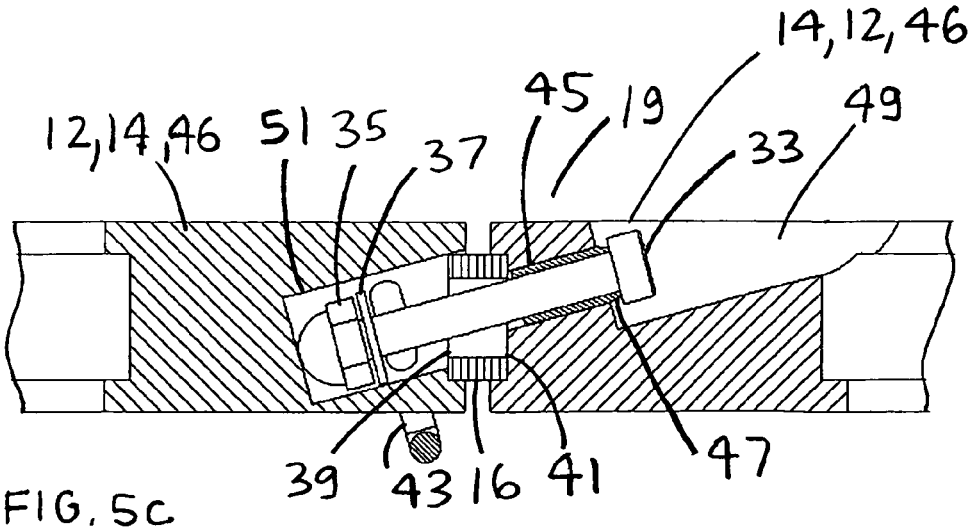
FIG. 5*c* is a cross sectional view cut through FIG. 5*b* of a removable window insulator in accordance with the present invention.

FIGS. 5*b*-5*d* illustrate an alternative method of sealing and securing the vertical frame member 12 to the horizontal frame member 14. An adjusting member 19 preferably includes a fastener 33, a nut 35 and a washer 37. However, other types of adjusting members may also be used. A vertical seal retention groove 39 is formed in an end of the vertical frame member 12 and a horizontal seal retention groove 41 is formed in an end of the horizontal frame member 14. The horizontal and vertical retention grooves improve sealing between the vertical and horizontal frame members. The vertical and horizontal seal retention grooves are sized to receive the compressible miter seal 16.

A nut hole 51 is formed in the vertical frame member 12. A U-shaped retention pin 43 is inserted into the nut hole 51 to retain the washer 37 and nut 35. A fastener hole 45 is formed through the vertical member 12, which is sized to receive a threaded insert 47. The threaded insert 47 reduces the amount of wear between the fastener 33 and the vertical frame member 12. The threaded insert 47 also transfers force from the adjusting member 19 to the horizontal frame member 14. At least one dowel 50 is used to align the horizontal and vertical frame members. A fastener head clearance pocket 49 is formed in the vertical frame member 12 to provide clearance for a head of the fastener 33. However, the threaded insert 47 could be disposed in the vertical frame member 12 and the nut hole 51 disposed in the horizontal frame member 14.

Figure 5E:
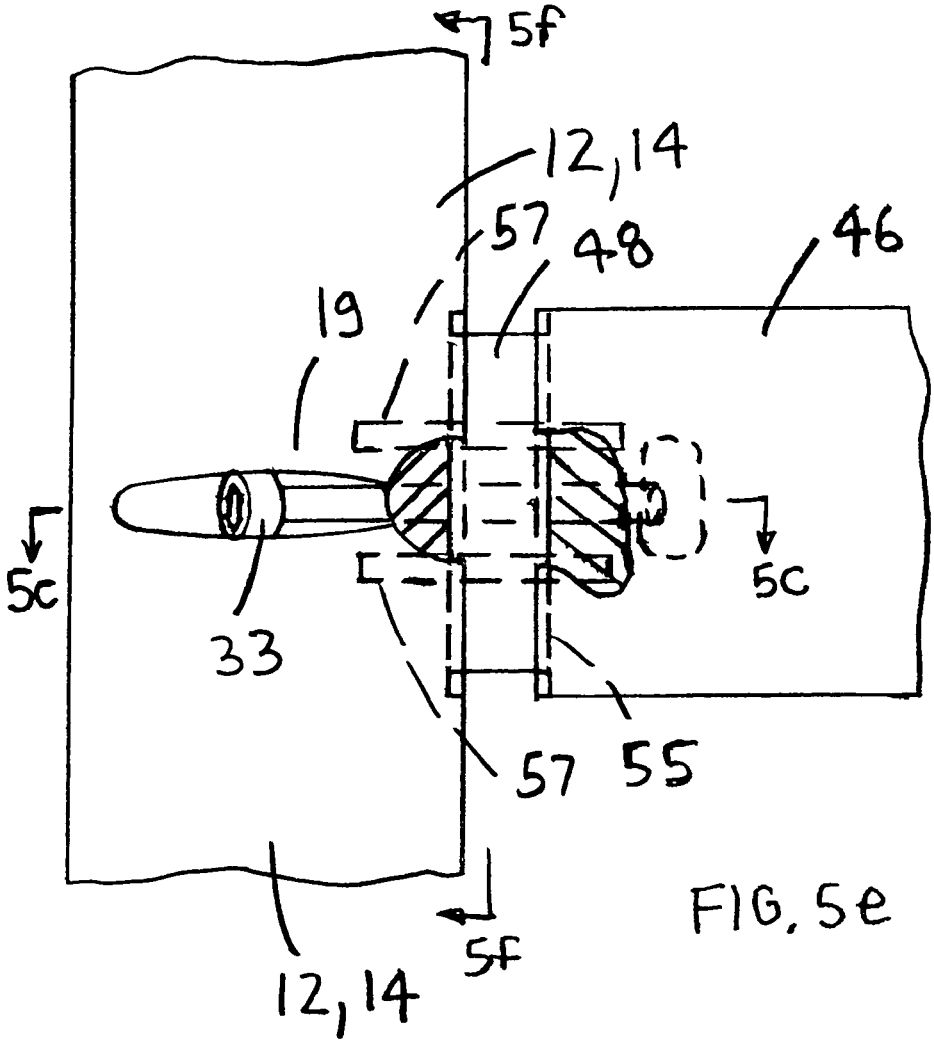
FIG. 5*e* is an enlarged front view of a junction between a vertical frame member, a cross member and a compressible seal of a removable window insulator using an alternative embodiment for sealing and securing thereof in accordance with the present invention.
Figure 5F:
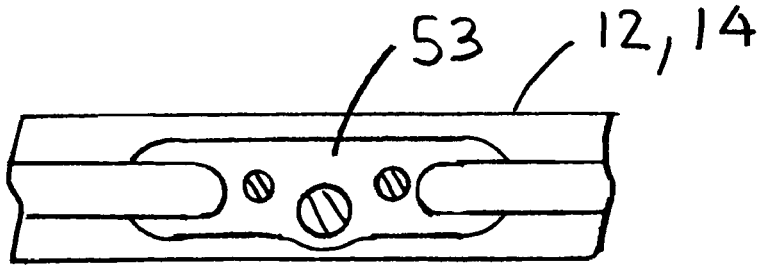
FIG. 5*f* is an enlarged end view of a seal pocket of a vertical frame member of a removable window insulator in accordance with the present invention.

FIGS. 5*e*-5*f* illustrate an alternative method of sealing and securing the cross member 46 to the vertical or horizontal frame member. FIG. 5*c* illustrates how the adjusting member 19 is used to secure the cross member 46 to the vertical or horizontal frame member. However, other types of adjusting members may also be used. A seal pocket 53 is formed in the vertical or horizontal frame member to receive the compression seal 48. A cross groove 55 is formed in an end of the cross member 46 to receive the compression seal 48. At least one dowel 57 is inserted into the cross member 46; the vertical or horizontal frame member; and through the compression seal 48. The at least one dowel 57 prevents twisting between the vertical or horizontal frame member and the cross member 48.

The fastener 33 is rotated in one direction to decrease the distance between the ends of two adjacent frame members or to decrease an outer perimeter of the removable window insulator 1. The same rotation direction could also decrease the distance between the frame member 12, 14 and the cross member 46. The fastener 33 is rotated in the opposite direction to increase the distance between two adjacent frame members and increase an outer perimeter of the removable window insulator 1. The same rotation direction could also increase the distance between the frame member 12, 14 and the cross member 46. An end of the nut 35 exerts force against a bottom of the nut hole 51 to increase the distance between the two adjacent frame members or between the frame member 12, 14 and the cross member 46.

Figure 6:
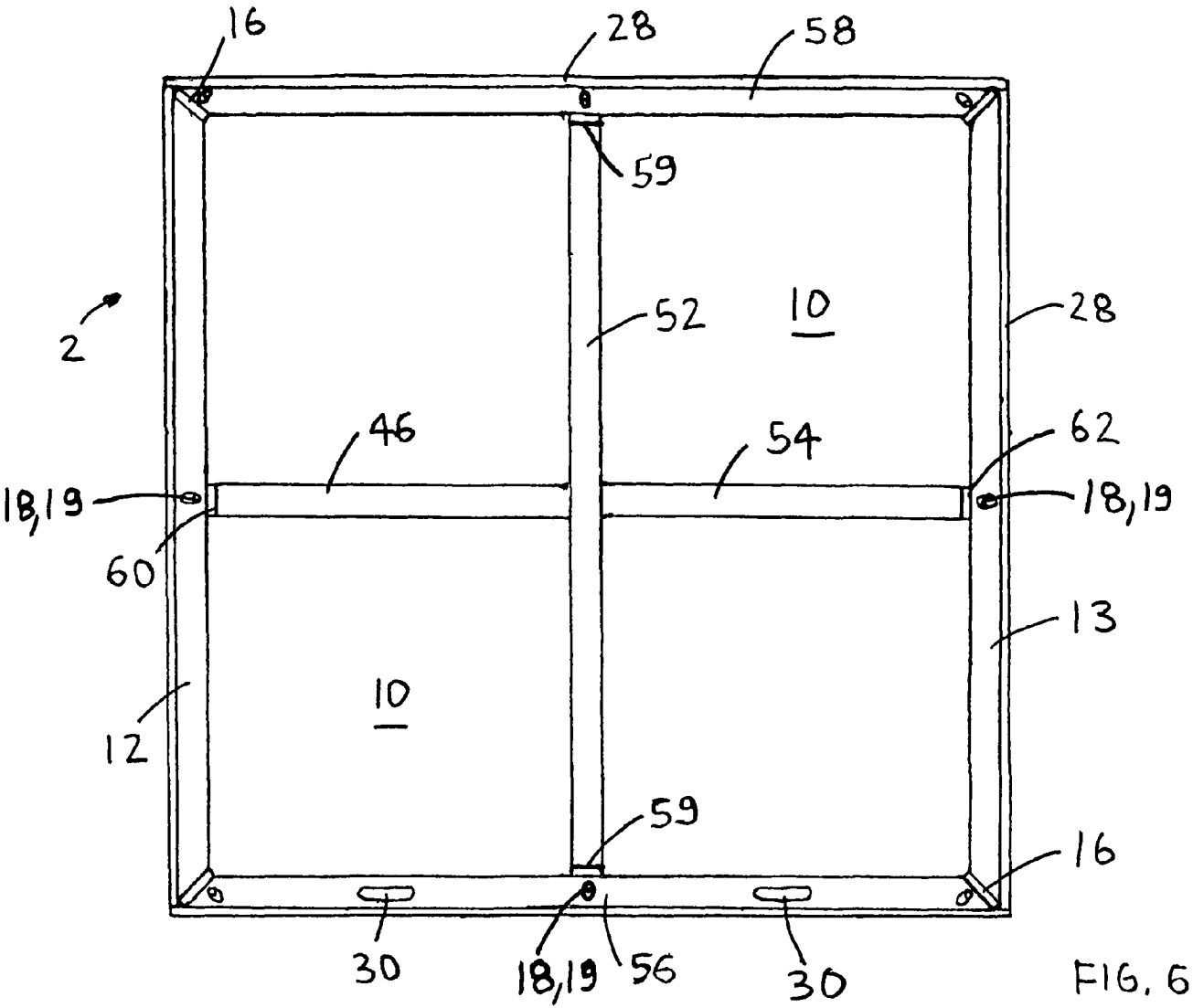
FIG. 6 is a front view of a second embodiment of a removable window insulator in accordance with the present invention.

With reference to FIG. 6, a second embodiment of the removable window insulator is used to seal a double window. The removable window insulator 2 additionally includes a vertical cross member 52 and a second horizontal cross member 54. A vertical compressible seal 59 is inserted between a first horizontal frame member 56 and one end of the vertical cross member 52. The vertical compressible seal 59 is also inserted between a second horizontal frame member 58 and the other end of the vertical cross member 52. Each end of the vertical cross member 52 is secured to the first and second horizontal frame members with two adjusting members 18, 19. The first and second horizontal frame members are made long enough to accommodate the width of a double window.

A first compressible seal 60 is inserted between the first vertical frame member 12 and one end of the first cross member 46. The one end of the first cross member 46 is secured to the first vertical frame member 12 with the adjusting member 18, 19. The other end of the first cross member 46 is rigidly attached to the vertical cross member 52 with any suitable fastening method. A second compressible seal 62 is inserted between a second vertical frame member 13 and one end of the second cross member 54. The one end of the second cross member 54 is secured to the vertical cross member 52 with the adjusting member 18, 19. The other end of the second cross member 54 is rigidly attached to the vertical cross member 52 with any suitable fastening method.

Figure 7:
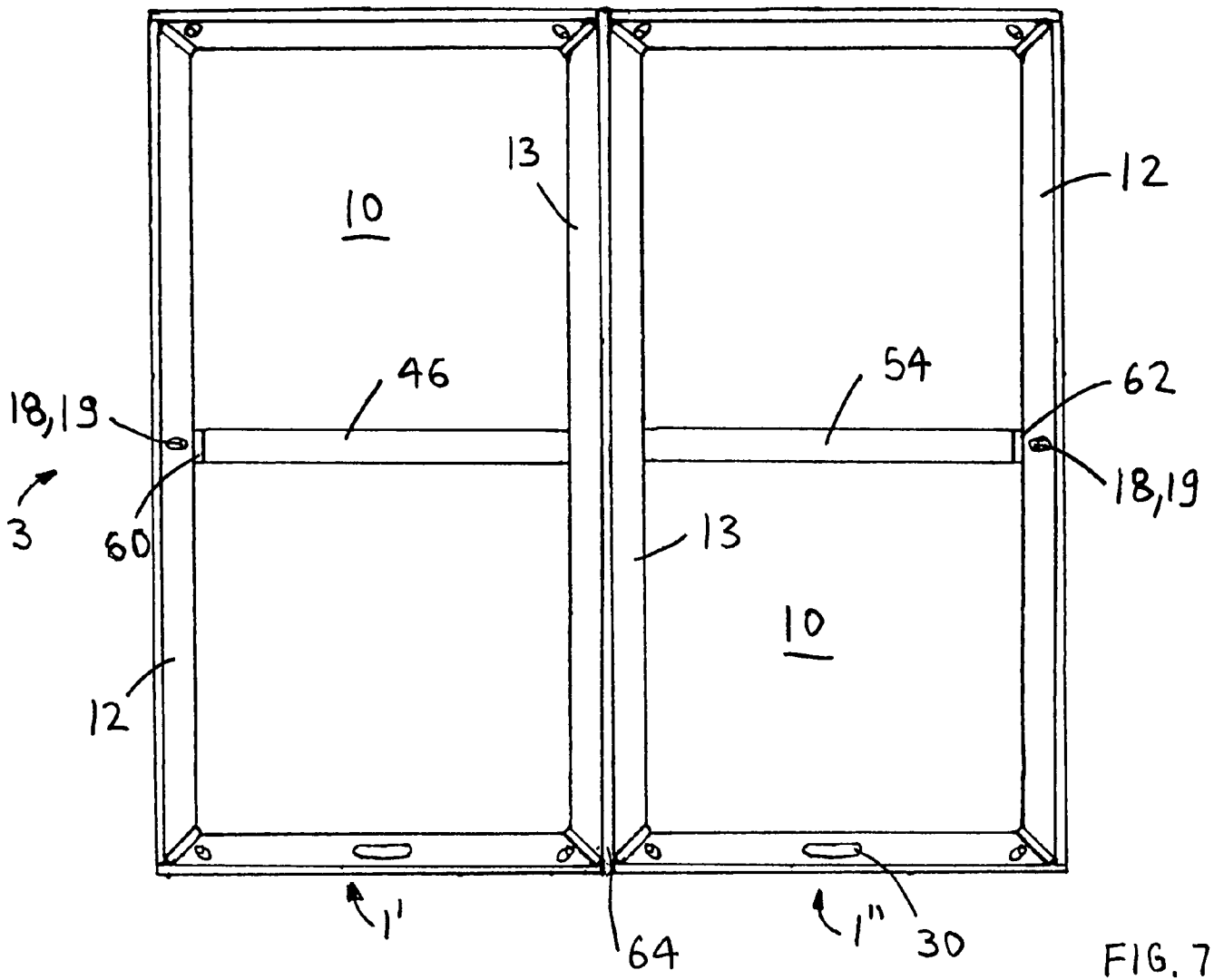
FIG. 7 is a front view of a third embodiment of a removable window insulator in accordance with the present invention.

With reference to FIG. 7, a third embodiment of the removable window insulator is used to seal a double window. The removable window insulator 3 additionally includes placing a first removable window insulator 1' adjacent to a second removable insulator 1". The first compressible seal 60 is inserted between the first vertical frame member 12 and one end of the first cross member 46. The one end of the first cross member 46 is secured to the first vertical frame member 12 with the adjusting member 18, 19. The other end of the first cross member 46 is rigidly attached to the second vertical frame member 13 with any suitable fastening method. The second compressible seal 62 is inserted between the first vertical frame member 12 and one end of the second cross member 54. The one end of the second cross member 54 is secured to the first vertical frame member 12 with the adjusting member 18, 19. The other end of the second cross member 54 is rigidly attached to the second vertical frame member 13 with any suitable fastening method.

The second vertical frame member 13 of the first removable window insulator 1' may be attached to the second vertical frame member 13 of the second removable window insulator 1" with fasteners or any other suitable attachment method. The second vertical frame member 13 of the first removable window insulator 1' may be attached to the second vertical frame member 13 of the second removable window insulator 1" with at least one hinge. If the at least one hinge is used, a vertical compressible seal 64 is retained between the second vertical frame members 13 of the first and second removable window insulators. The vertical compressible seal 64 may also be included, when fasteners are used to attach the first and second removable window insulators to each other.

Figure 8:
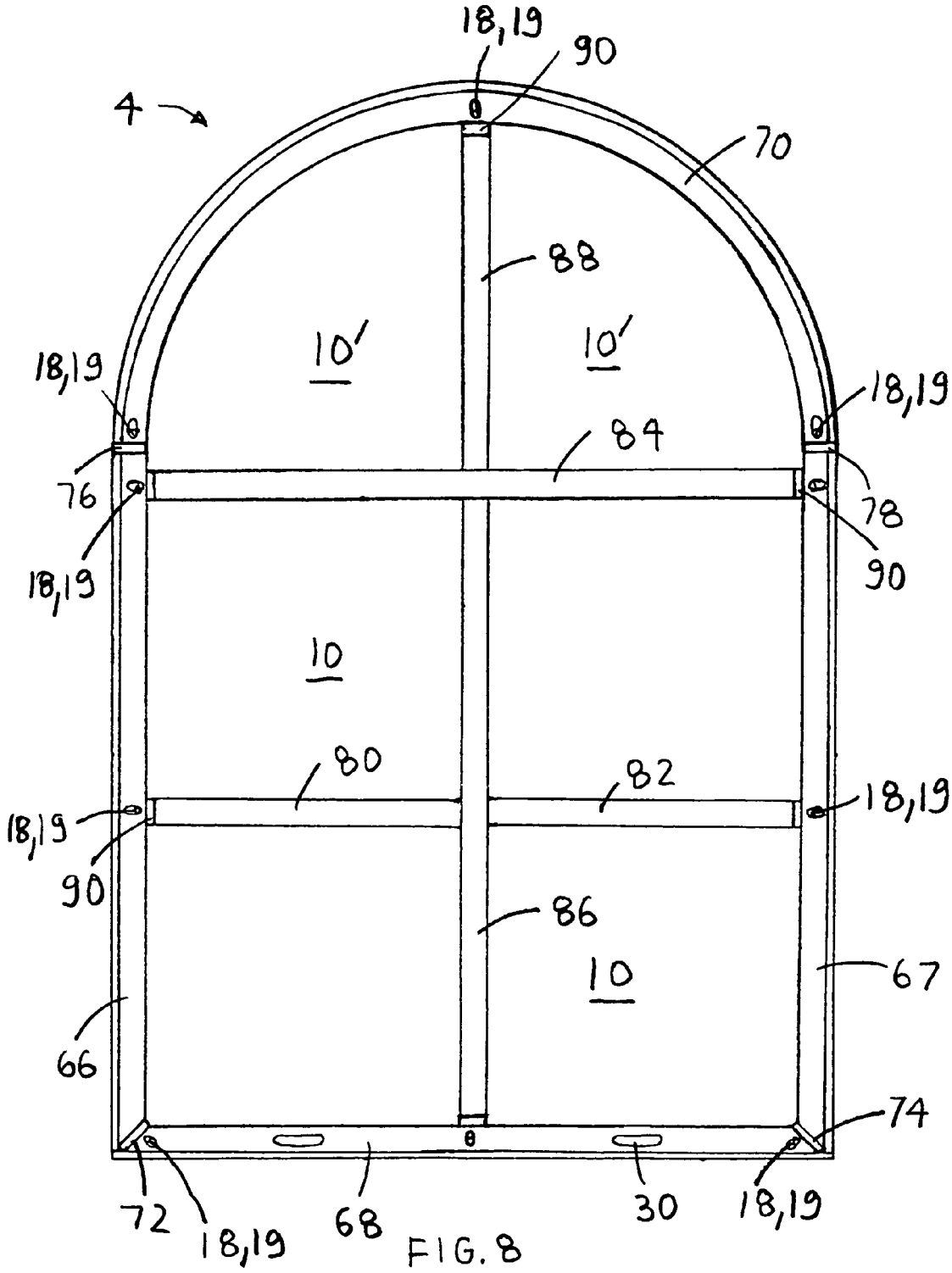
FIG. 8 is a front view of a fourth embodiment of a removable window insulator in accordance with the present invention.

With reference to FIG. 8, a fourth embodiment of the removable window insulator is used to seal a large window with a partially curved perimeter. The removable window insulator 4 includes a first vertical frame member 66, a second vertical frame member 67, a horizontal frame member 68 and a curved frame member 70. A first compressible miter seal 72 is inserted between one end of the first vertical frame member 66 and one end of the horizontal frame member 68. The one end of the first vertical frame 66 is secured to one end of the horizontal frame member 68 with the adjusting member 18, 19.

A second compressible miter seal 74 is inserted between the junction of one end of the second vertical frame member 67 and the other end of the horizontal frame member 68. The one end of the second vertical frame 67 is secured to one end of the horizontal frame member 68 with the adjusting member 18, 19. A first compressible seal 76 is inserted between one end of the curved frame member 70 and the other end of the first vertical frame member 66. The one end of the curved frame member 70 is secured to the other end of the first vertical frame member 66 with the adjusting member 18. A second compressible seal 78 is inserted between the other end of the curved frame member 70 and the other end of the second vertical frame member 67. The other end of the curved frame member 70 is secured to the other end of the second vertical frame member 67 with the adjusting member 18, 19.

Preferably, the removable window insulator 4 further includes a first horizontal cross member 80, a second horizontal cross member 82, a third horizontal cross member 84, a first vertical cross member 86 and a second vertical cross member 88. A cross compressible seal 90 is inserted between one end of the first vertical cross member 86 and the first horizontal frame member 68. The one end of the first vertical cross member 86 is secured to the first horizontal frame member 68 with the adjusting member 18, 19. A single cross compressible seal 90 is inserted between one end of the first horizontal cross member 80 and the first vertical frame member 66. The one end of the first horizontal cross member 80 is secured to the first vertical frame member 66 with the adjusting member 18. The other end of the first horizontal cross member 80 is rigidly attached to the first vertical cross member 86.

The cross compressible seal 90 is inserted between one end of the second horizontal cross member 82 and the second vertical frame member 67. The one end of the second horizontal cross member 82 is secured to the second vertical frame member 67 with the adjusting member 18, 19. The other end of the second horizontal cross member 82 is rigidly attached to the first vertical cross member 86. A single cross compressible seal 90 is inserted between one end of the third horizontal cross member 84 and the first vertical frame member 66. The one end of the third horizontal cross member 84 is secured to the first vertical frame member 66 with the adjusting member 18, 19. The cross compressible seal 90 is inserted between the other end of the third horizontal cross member 84 and the second vertical frame member 67. The other end of the third horizontal cross member 84 is secured to the second vertical frame member 67 with the adjusting member 18, 19.

The other end of the first vertical cross member 86 is rigidly attached to substantially a middle of the third horizontal cross member 84. One end of the second vertical cross member 88 is rigidly attached to substantially a middle of the third horizontal cross member 84. The cross compressible seal 90 is inserted between the other end of the second vertical cross member 88 and the curved frame member 70. The second vertical cross member 88 is secured to the curved frame member 70 with the adjusting member 18.

Assembly details shown in FIGS. 1-5*a* of the removable window insulator 1 also apply to the removable window insulators 2-4. Assembly details shown in FIGS. 5*b*-5*f* of the removable insulator 1 also apply to the removable window insulators 2-4. The removable window insulator 1-4 should not be limited to installation in windows only, but should include skylights, sliding doors and any other appropriate application.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of forming a removable window insulator, comprising the steps of:

providing at least four frame members;

mitering each end of at least one of said at least four frame members;

inserting a compressible seal between mitered ends of two substantially perpendicular frame members of said at least four frame members before securing said two substantially perpendicular frame members to each other;

retaining said mitered ends of said two substantially perpendicular frame members adjacent to each other with a fastener, a head end of said fastener is disposed in one of said two substantially perpendicular frame members, the other end of said fastener is retained in the other one of said two substantially perpendicular frame members, rotation of said fastener in one direction increases a distance between said mitered ends of said two substantially perpendicular frame members, rotation of said fastener in an opposite direction decreases a distance between said mitered ends of said two substantially perpendicular frame members;

sealing at least one pane to an inside edge perimeter of said at least four frame members; and applying a sealing strip to an outside edge of said at least four frame members.

2. The method of forming a removable window insulator of claim 1, further comprising the step of:

retaining at least one cross member within said inside edge perimeter of said at least four frame members.

3. The method of forming a removable window insulator of claim 2, further comprising the step of:

inserting a single cross compressible seal between an end of one of said at least one cross member and one of said at least four frame members.

4. The method of forming a removable window insulator of claim 3, further comprising the step of:

securing said end of one of said at least one cross member to one of said at least four frame members with a cross adjusting member.

5. The method of forming a removable window insulator of claim 3, further comprising the step of:

forming a seal pocket in one of said at least four frame members, forming a groove in an end of one of said at least one cross member, said seal pocket and said groove being sized to receive said cross compressible seal.

6. The method of forming a removable window insulator of claim 1, further comprising the steps of:

applying a front seal strip to a front peripheral edge of each one of said at least one pane; and applying a rear seal strip to a rear peripheral edge of each one of said at least one pane.

7. The method of forming a removable window insulator of claim 1, further comprising the steps of:

rotating at least one said fastener to fit said removable window insulator into a window frame.

8. The method of forming a removable window insulator of claim 1, further comprising the step of:

forming a first groove in an end of one of said two adjacent frame members, forming a second groove in an end of the other of said two adjacent frame members, said first and second grooves being sized to receive said compressible seal.

9. The method of forming a removable window insulator of claim 1, further comprising the step of:

forming a groove around said outside edge of at least one of said four frame members to receive said sealing strip.

10. A method of forming a removable window insulator, comprising the steps of:

providing at least four frame members;

mitering each end of at least one of said at least four frame members;

inserting a compressible seal between mitered ends of two substantially perpendicular frame members of said at least four frame members before securing said two substantially perpendicular frame members to each other;

retaining said mitered ends of said two substantially perpendicular frame members adjacent to each other with a fastener, a head end of said fastener is disposed in one of said two substantially perpendicular frame members, the other end of said fastener is retained in the other one of said two substantially perpendicular frame members, rotation of said fastener in one direction increases a distance between said mitered ends of said two substantially perpendicular frame members, rotation of said fastener in an opposite direction decreases a distance between said mitered ends of said two substantially perpendicular frame members, an outside perimeter of said at least four frame members is increased when said fastener is rotated in said one direction, said outside perimeter of said at least four frame members is decreased when said fastener is rotated in said opposite direction;

sealing at least one pane to an inside edge perimeter of said at least four frame members; and applying a sealing strip to an outside edge of said at least four frame members.

11. The method of forming a removable window insulator of claim 10, further comprising the step of:

retaining at least one cross member within said inside edge perimeter of said at least four frame members.

12. The method of forming a removable window insulator of claim 11, further comprising the step of:

inserting a single cross compressible seal between an end of one of said at least one cross member and one of said at least four frame members.

13. The method of forming a removable window insulator of claim 12, further comprising the step of:

securing said end of one of said at least one cross member to one of said at least four frame members with a cross adjusting member.

14. The method of forming a removable window insulator of claim 10, further comprising the steps of:

applying a front seal strip to a front peripheral edge of each one of said at least one pane; and applying a rear seal strip to a rear peripheral edge of each one of said at least one pane.

15. The method of forming a removable window insulator of claim 10, further comprising the step of:

forming a first groove in an end of one of said two adjacent frame members, forming a second groove in an end of the other of said two adjacent frame members, said first and second grooves being sized to receive said compressible seal.

16. The method of forming a removable window insulator of claim 10, further comprising the step of:

forming a groove around said outside edge of at least one of said four frame members to receive said sealing strip.

17. A method of forming a removable window insulator, comprising the steps of:

providing at least four frame members;

mitering each end of at least one of said at least four frame members;

inserting a compressible seal between mitered ends of two substantially perpendicular frame members of said at least four frame members before securing said two substantially perpendicular frame members to each other;

retaining said mitered ends of said two substantially perpendicular frame members adjacent to each other with a fastener, a head of said fastener is disposed in one of said two substantially perpendicular frame members, the other end of said fastener is retained in the other one of said two substantially perpendicular frame members, rotation of said fastener in one direction increases a distance between said mitered ends of said two substantially perpendicular frame members through the memory properties of said compressible seal, rotation of said fastener in an opposite direction decreases a distance between said mitered ends of said two substantially perpendicular frame members;

sealing at least one pane to an inside edge perimeter of said at least four frame members; and applying a sealing strip to an outside edge of said at least four frame members.

18. The method of forming a removable window insulator of claim 17, further comprising the step of:

retaining at least one cross member within said inside edge perimeter of said at least four frame members.

19. The method of forming a removable window insulator of claim 18, further comprising the step of:

inserting a single cross compressible seal between an end of one of said at least one cross member and one of said at least four frame members.

* * * * *